US007874182B1

(12) United States Patent
Lindahl

(10) Patent No.: US 7,874,182 B1
(45) Date of Patent: Jan. 25, 2011

(54) CROCHET HOOK WITH ERGONOMIC CONFIGURATION

(76) Inventor: Sandra Kay Lindahl, 503 - 72nd St., Holmes Beach, FL (US) 34217

( * ) Notice: Subject to any disclaimer, the term of this patent is extended or adjusted under 35 U.S.C. 154(b) by 0 days.

(21) Appl. No.: 12/361,395

(22) Filed: Jan. 28, 2009

(51) Int. Cl.
*D04B 3/02* (2006.01)

(52) U.S. Cl. ..... 66/118

(58) Field of Classification Search ..... 66/1 A, 66/116, 117, 118
See application file for complete search history.

(56) References Cited

U.S. PATENT DOCUMENTS

| | | | | | |
|---|---|---|---|---|---|
| 1,091,395 | A | * | 3/1914 | Sencenbaugh | 66/118 |
| 1,355,878 | A | * | 10/1920 | Sencenbaugh | 66/118 |
| 1,358,067 | A | * | 11/1920 | Ensfield | 66/118 |
| 1,376,151 | A | * | 4/1921 | Mitchell | 66/118 |
| 1,415,472 | A | * | 5/1922 | Puc | 66/118 |
| 1,477,427 | A | * | 12/1923 | Christensen | 66/118 |
| 1,502,584 | A | * | 7/1924 | Perry | 66/118 |
| 1,518,961 | A | * | 12/1924 | Burns | 66/118 |
| 1,536,274 | A | * | 5/1925 | Semonsen | 66/117 |
| RE16,360 | E | * | 6/1926 | Stephens | 66/117 |
| 1,587,082 | A | * | 6/1926 | Mattern | 473/201 |
| 1,692,583 | A | * | 11/1928 | Shepperack | 66/117 |
| 1,709,631 | A | * | 4/1929 | Schmidt | 66/117 |
| 2,117,143 | A | * | 5/1938 | Burger | 66/117 |
| 2,133,431 | A | * | 10/1938 | Craft | 66/117 |
| 2,246,254 | A | * | 6/1941 | Johnston | 66/118 |
| 2,276,062 | A | * | 3/1942 | Peyser | 235/114 |
| 2,290,432 | A | * | 7/1942 | Hokstad | 66/117 |
| 2,364,649 | A | * | 12/1944 | Palliser | 66/117 |
| 2,440,413 | A | * | 4/1948 | Mock | 66/118 |
| 2,446,622 | A | | 8/1948 | Turner | |
| 2,465,636 | A | * | 3/1949 | Doerr | 66/118 |
| 2,486,184 | A | * | 10/1949 | Maker et al. | 66/117 |
| 2,538,635 | A | * | 1/1951 | Wahle | 66/117 |
| 2,601,769 | A | * | 7/1952 | Visconti | 66/118 |
| 2,608,077 | A | * | 8/1952 | Suessman | 66/118 |
| 2,635,444 | A | * | 4/1953 | Carlson | 66/118 |
| 2,738,662 | A | * | 3/1956 | Carlson | 66/118 |
| 3,228,212 | A | * | 1/1966 | Huber | 66/117 |
| 3,678,712 | A | * | 7/1972 | Singleton | 66/118 |
| 3,732,869 | A | * | 5/1973 | Bronstein | 606/118 |
| 4,047,397 | A | * | 9/1977 | Laliberte | 66/118 |
| 4,280,641 | A | * | 7/1981 | Eacret | 223/1 |
| D269,734 | S | | 7/1983 | Okada | |
| D271,062 | S | | 10/1983 | Okada | |
| 4,501,133 | A | * | 2/1985 | Kretzschmar et al. | 66/117 |
| D298,698 | S | | 11/1988 | Okada | |
| 5,042,804 | A | * | 8/1991 | Uke et al. | 473/538 |
| D556,443 | S | | 12/2007 | Mihara | |
| D567,438 | S | * | 4/2008 | Srivastava | D28/10 |
| D567,439 | S | * | 4/2008 | Srivastava | D28/10 |

* cited by examiner

*Primary Examiner*—Danny Worrell
(74) *Attorney, Agent, or Firm*—Dorothy S. Morse

(57) ABSTRACT

A crochet hook with one or more elevation changes associated with the exterior surface of its elongated shaft that provide ergonomic benefit on the grip area of the shaft typically held by a person crocheting, to allow crocheting with enhanced comfort, faster crocheting, and/or crocheting for longer periods of time with less risk of hands becoming tired, numb, or aching from the repetitive motion inherent in crocheting activity. The hook's shaft may also have different cross-sectional configurations that provide ergonomic benefit, such as that of a triangle with softened edges, instead of the traditional circular shape still most commonly used. The elevation changes typically extend longitudinally along the crochet hook shaft a minimum of approximately two-and-one-half to three inches, and are not usually positioned on the hook associated with the crochet hook's shaft, or within approximately one to one-and-one-eighth inches thereof.

20 Claims, 2 Drawing Sheets

CROCHET HOOK WITH ERGONOMIC CONFIGURATION

CROSS-REFERENCES TO RELATED APPLICATIONS

None

BACKGROUND

1. Field of the Invention

This invention relates to elongated hand-held instruments or tools having a hook on at least one of its ends that is used for crocheting yarn, fibers, strands and/or other elongated filamentous material into two-dimensional and three-dimensional shapes, specifically to a crochet hook with one or more elevation changes (raised protrusions and/or depressions) associated with the exterior surface of its elongated shaft that are designed and structured to provide ergonomic benefit to people using it, making the crochet hook more functional to hold with less risk of fingers and hands becoming prematurely tired, numb, or aching as a result of the repetitive motion inherent in crocheting activity, thereby facilitating crocheting activity and allowing it to take place with enhanced comfort, greater speed, and/or for longer periods of time than is currently possible with the commonly sold crochet hooks of today which have a smooth exterior surface, a centrally-located and flattened thumb gripping area, and a shaft with a circular cross-sectional configuration. The elevation changes of the present invention may begin from approximately one-and-one-eighth of an inch from the tip of its hook and extend longitudinally over the remaining portion of the shaft's exterior surface, or in the alternative extend at least through a distance of approximately three-and-one-half to four-and-one-half inches. They also extend laterally around the shaft to accommodate fingertips or portions of a hand that may be in contact with the underside portion of the shaft. Since a person does not hold onto the hook while creating new loops (or the tapering portion of the shaft immediately adjacent thereto), there would be little ergonomic benefit derived from placing elevation changes on (or close to) the hook of a present invention crochet hook, and elevation changes on or close to its hook are not preferred. Other reasons for not positioning raised protrusions and/or depressions positioned close to a present invention hook is that they might interfere with efficient loop creation and/or movement relating to the establishment of a proper/uniform gauge, and in addition, the use of depressions thereon might adversely affect the structural integrity of the tapered portion of the shaft. Crocheting activity typically involves, but is not limited to, the making of stitches or patterns by pulling new loops one-at-a-time (in varying combinations as needed) through one or more previously created loops, and then if such activity causes more than one loop to become associated with the crochet hook, removing excess loops from the crochet hook (one or more at a time) until only a single loop remains that can be tied off or used as a basis to continue the next stitch or pattern. Crocheting activity can be faster paced than knitting activity, particularly when working double and triple crochet patterns where several chain stitches are created in a rapid sequence and then secured to other loops or stitches. Consequently, the repeated back-and-forth motion (extension and flexion) of the fingers on the hand holding the crochet hook to change the orientation of the hook for its successful engagement with a strand positioned behind a work-in-progress, and then reorientation of the hook to draw that strand through a pre-existing loop, can be rapid and quickly fatigue the fingers and hands. Furthermore, the faster pace is crocheting may lead to increased pressure of a person's fingers and hands around a crochet hook, leading to premature numbness and fatigue. In addition, manipulation of the hook and strand to achieve uniform tension in the loops comprising a work-in-progress also fatigues fingers and hands, and is responsible at least in part for causing the diminished blood circulation condition commonly referred to as "pins and needles" that people crocheting also experience. When an overhand knife grip is used to hold a crochet hook, more wrist action is typically experienced for hook rotation and manipulation, however, when an underhand pencil grip is used, less wrist action and more finger movement is typically employed. Regardless of whether a knife or pencil grip is used, since a crochet hook must be securely held in the hand for rotation and/or other manipulation of the hook that allows it to draw a new loop through an existing one, pressure is continually exerted against the crochet hook shaft during crocheting activity by at least a portion of the user's fingers and hands, causing them to prematurely tire and experience diminished blood circulation. The present invention modifies its shaft through elevation changes (or elevation changes and differing non-circular cross-sectional configurations) to allow a user the opportunity to change finger and hand positioning along its shaft and thereby receive at least periodic relief. A centralized and flattened thumb grip area is a common feature on many crochet hooks currently sold (as well as on many crochet hooks passed from one generation to the next), and although it does place the hand of a person crocheting in an optimal orientation relative to the hook for its prompt and easy rotation during new loop creation, as well as place the hand holding it at a convenient distance from the hook for efficient and expeditious loop and pattern completion, the flattened thumb grip area also has the significant disadvantage of limiting hand and finger positioning primarily to the flattened thumb grip area and maintaining the crochet hook shaft in a substantially fixed orientation relative to the hand. It is this limited opportunity for hand positioning and the fixed orientation relative to the fingers and hand (in combination with the repetitive motion inherent in crocheting activity) that at least in part contributes to the hand stiffness and injury of people crocheting, beginners as well as those with more experience and those who like to crochet often. In contrast, the present invention elevation changes, including those replacing the flattened thumb grip area found on prior art crochet hooks, promote the opportunity for a user to consciously or subconsciously (out of habit) repeatedly achieve subtle and sometimes deliberate changes in hand positioning and orientation relative to the crochet hook shaft that provides sufficient differences in pressure between portions of the fingers and hands of a person crocheting and the crochet hook shaft to provide ergonomic relief, since as longitudinal, lateral, and/or rotational movement of the crochet hook shaft occurs, the fingers and hands of the person holding a present invention crochet hook will encounter different topography, thereby relieving (or at least lessening) the pressure exerted by the shaft against part or all of the finger and hand tissue that immediately thereto had been experiencing diminished blood circulation, giving it relief at least until the next longitudinal, lateral, and/or rotational shift in positioning occurs. Beneficial hand and finger movement may occur longitudinally along a present invention crochet hook shaft and/or laterally around it with variation in hand and finger positioning/alignment occurring as many times as is needed by the user to lessen the likelihood of the hands and fingers becoming prematurely tired and/or numb (or find a more comfortable hand and finger positioning), and in virtually any direction including diagonally (as long as the hook maintains a convenient orientation for easy and prompt new loop creation. Furthermore, the finger and hand movement is brief and non-distracting (sometimes occurring subconsciously), and does not affect the tension of loops incorporated into a work-in-progress. In addition, since crocheting is typically performed by people in a seated position with hands outstretched generally in front of them in a location where loop creation and manipulation can most readily and easily be observed, the arms, neck, shoulders, and back of a person crocheting can also become fatigued as time advances and the weight of a work-in-progress suspended from the person's hands increases.

In addition to the elevation changes used, present invention crochet hooks may also optionally comprise different non-circular cross-sectional configurations that are structured with softened edges/corners (and/or otherwise) to provide additional ergonomic benefit to people crocheting, such as the configuration of a triangle, in place of the traditional and non-ergonomic circular cross-sectional configuration historically and still most commonly used. The non-circular cross-sectional configuration may extend longitudinally from one end of the present invention crochet hook shaft to the other and is contemplated to extend fully around it to accommodate and provide relief for any hand or finger tissue in contact with the underside portion of the shaft. In the alternative, the non-circular cross-sectional configuration may extend the fill length of a present invention crochet hook shaft, or be positioned only in the area of the shaft most likely grasped during new loop creation (from a distance of approximately one-and-one-eighth inches to a maximum of approximately four-and-one-half inches from the attached hook), or have any positioning therebetween. Elevation changes in the present invention are purposefully arranged in patterns configured to space apart the contact areas created between the hands or fingers of a person crocheting and the elongated crochet hook shaft they hold so that non-contact areas adjacent thereto have sufficient size and spacing to allow enhanced blood circulation in the hand or finger tissue aligned with them. As a result, even though the blood circulation in some parts of the hands and fingers of a person crocheting becomes diminished as a result of holding and moving a present invention crochet hook shaft during new loop creation (those parts pressed against the most raised contact areas, which can be protrusions or portions of the exterior surface of the shaft), blood circulation in hand and finger tissue adjacent thereto remains less affected and is allowed to regain normal or near normal levels. Then, when the user consciously or subconsciously rotates hand and finger positioning and/or shifts it longitudinally or diagonally along a present invention shaft, the tissue previously experiencing diminished blood circulation is very often given immediate relief, while tissue adjacent thereto now comes into contact with higher elevation changes and has greater pressure exerted against it by the shaft. The hands and fingers of a person crocheting with a traditional crochet hook having a circular cross-section, uniform diameter, and smooth exterior surface is not provided with similar opportunities for blood circulation relief, as every time the smooth crochet hook shaft is re-grasped, the tissue in the fingers and hands encounter the same lack of surface topography and resulting uniform pressure against it. More than one size or shape of elevation change may be used at once on a present invention crochet hook shaft, for decorative accent as well as ergonomic benefit, and the spacing between adjacent elevation changes (identical, differing size, randomly spaced, and/or uniformly spaced) may also vary on each present invention crochet hook, in addition to being different from the spacing of elevation changes selected during manufacture for any other present invention crochet hook shaft. The present invention crochet hook shafts can also be made in different length and diameter dimensions, including standard crochet hook sizes, so as to not require the person crocheting to make any fundamental changes in crocheting habits to achieve the gauge recommendations displayed in currently available crocheting pattern books and/or other written instructional crocheting information. Furthermore, since new loop creation typically involves moving each loop fully onto a crochet hook shaft to achieve a correct gauge (or at least provide uniformity in the size of the loops made), appropriate accommodation for present invention elevation changes would be taken into consideration during manufacture of standard crochet hook sizes so that the needed gauge is present and not compromised.

2. Description of the Related Art

Crocheting is a creative activity that is frequently a labor of love enjoyed by those doing it, and those crocheting will commonly spend long periods of time on a work-in-progress for the creative stimulus or just because they enjoy doing it, sometimes to their physical detriment. Furthermore, people who enjoy crocheting will often continue it throughout their lifetime, even when arthritis and various joint problems experienced as they age make it more difficult to perform. A current and common complaint among people crocheting is that their hands and fingers frequently become tired and ache as a result of their crocheting activity, and the numbing condition of decreased circulation commonly referred to as the sensation of "pins and needles" also frequently occurs. However, most people crocheting enjoy the creative process enough that they are unwilling to stop crocheting even if temporary discomfort exists. Crocheting is also a widespread and longstanding activity, with the same crochet hooks having a circular cross-sectional configuration (most also having a centrally-located flattened grip area configured for engagement with the user's thumb and opposed index finger) being passed down in families from one generation to the next. Furthermore, crocheting is typically accomplished by a person in a seated position, with the crochet hook held in an elevated position at or above waist level for optimum visibility of loop formation, as one or more newly formed loops are pulled through one or more of the loops remaining on the hook to complete pattern steps. However, it is the same precise and consistent repetitive crocheting movement that admirably produces even tension and a uniform look in a finished crocheted piece (something that most people crocheting try to achieve) that causes (or at least contributes to) the tired, achy, and numbing of fingers and hands characteristic of many people devoted to crocheting. Also contributing to this problem, is the fact that during crocheting activity, the portion of the crocheted product located between the person's hands and lap is always hanging from the hook (usually growing steadily in size and weight), and it is suspended solely from the person's hands and fingers. As one can imagine, as it grows in size a large work-in-progress, such as but not limited to the front or back of an adult sweater or coat, a shawl or a poncho, or an afghan, will become quite heavy for the person's fingers to support, and will also eventually provide an adverse affect on the person's hands, arms, shoulders, and back if crocheting activity extends over a long period of time or is conducted repeatedly on successive days, particularly when heavier weight yarns are involved. Thus, by their devotion to crocheting activity over a period of years, a person crocheting can also risk repetitive motion injury such as carpal tunnel injury, arthritic pain, and/or permanent finger deformity.

Correct and consistent tension is an important aspect of crocheting that is needed to produce an even and aesthetically appealing look in many finished projects, as well as insure that a crocheted piece of clothing is true-to-size when printed instructions are followed, and the person crocheting must focus consciously or unconsciously (out of habit) on providing proper yarn/fiber/strand tension as new loops are pulled through the previously remaining loop or loops on the hook. However, providing proper tension also requires greater pressure of the hands and fingers of the person crocheting against a crochet hook shaft, and contributes to the person's continued discomfort and eventual injury. Another factor contributing to finger and hand injury in people crocheting is the flattened thumb grip area common to a large majority of the crochet hooks currently sold, which has the good purpose of maintaining the crochet hook shaft in a substantially fixed position relative to the hand for efficient hook manipulation. However, it also has the disadvantage of restricting hand and finger movement relative to the shaft, which due to the repetitive nature of crocheting activity can lead to premature hand and finger discomfort and injury. Also contributing to this discomfort and injury is the fact that a work-in-progress steadily becomes heavier as crocheting activity continues.

The inventor herein has sought a solution to the problem from three different approaches, first by focusing on possible changes to the crocheting process, second by focusing on possible changes to the person's hands, and third by focusing on possible changes to the crochet hook itself. Since crocheting activity as it is known today has been conducted for such a long time, and there are so many printed and published patterns available that a person crocheting would want to try in a new color or repeat in a different size, changing the fundamentals of the crocheting process appears to be a monumental task that would take a significant amount of time to bring into the mainstream. Therefore, this approach was not considered a viable alternative, since it would provide no immediate relief to people currently crocheting who are set in their ways. Changing the configuration of the hands of a person crocheting could involve padding, similar in concept to providing padded gloves to cyclists for numbness prevention in hands and forearms during long rides. However, the addition of padding or gloves to a person's fingers or hands while crocheting might make the fingers less flexible and lessen crocheting speed. Furthermore, the use of padding or gloves might not allow the yarn/fiber/strand applied by an index finger to slip easily over it and could have an adverse impact on tension. Additionally, padding or gloves would remove some of the tactile pleasure involved in the crocheting process, relating to the soft feel of some yarns or strands. Furthermore, padding and gloves would need periodic laundering so that they have no adverse affect on a work-in-progress, and the use of gloves may overheat a person crocheting unless made from breathable materials. Therefore it was concluded that even if padding or gloves were made available, most people crocheting would prefer to work without it, seeing the disadvantages outweighing the benefits.

The last approach considered by the inventor herein to reduce injury risk to the hands and fingers of people crocheting was to change the crochet hook itself. However, since the crochet hooks with a circular cross-section and a smooth exterior surface that were used by our grandparents and their ancestors, are still widely and commonly used today in spite of their tendency to cause discomfort with extended use, for a crochet hook modification that provides ergonomic benefit to become widely adopted, it would have to not radically change the way crochet hook shafts are held in the fingers and hand. In addition, the change cannot involve the use of soft and/or resilient materials on the hook or close to it, as the uniformity of loops would be more difficult to control, the tension and gauge of a finished product could be adversely affected, the speed of crocheting would most likely be reduced, and/or the ease of loop movement over the hook would be diminished. Also, the addition of rubber material with elasticity over the exterior surface of the center portion of a crochet hook shaft has been tried, and was disclosed in 1996 via Japanese patent abstract 10-131003 published May 19, 1998 in the name of Takagi Shosuke (for application number 08-307087 filed Nov. 1, 1996). However, the illustration on the Shosuke cover sheet shows the rubber material positioned over most of the flattened grip area configured for engagement with the user's thumb, forcing the user's fingers back away from the hook a significant distance that would make it difficult for the person to introduce new strands (and create new loops therewith) without repositioning at least some of the user's fingers into direct contact with the smooth exterior surface closer to the hook, which at least in part would defeat the purpose behind providing the rubber material for "improved comfort and workability", as stated. Thus, to solve the problem of hand fatigue and the other problems experienced by people crocheting that are mentioned hereinabove, the present invention implements the use of resilient and/or non-resilient protrusions that extend upwardly beyond the exterior surface of a crochet hook shaft, depressions extending below the exterior surface of a crochet hook shaft, and/or other elevation changes associated with the exterior surfaces of its crochet hook shafts, at least in the areas thereof anticipated to be most commonly held by people crocheting during new loop creation (which typically extends from approximately one-and-one-eighth inches from the tip of its hook to approximately three-and-one-half to four-and-one-half inches from the hook, but may extend all of the way to the end of the shaft opposed from the hook). In addition, present invention crochet hook shafts may also optionally comprise ergonomically-enhancing cross-sectional configurations that are non-circular and distinct from the traditional crochet hook shafts commonly used. As a result, some present invention embodiments will comprise elevation changes on a circular cross-section crochet hook, whereas other present invention embodiments (such as but not limited to those involving the use of heavier weight yarns or where very small crochet hooks are involved that are difficult and tedious to hold) may require elevation changes and a shaft with a non-circular cross-sectional configuration to provide people crocheting with ergonomic benefit. Non-raised decorative markings can also be used on portions of the shaft, the hook, and/or the tapering work area adjacent to the hook, to complement or provide a contrast to the elevation changes used. In searching the Internet and retail stores for prior art changes to the traditional crochet hooks having a circular cross-sectional configuration, most crochet hooks found for sale still have the traditional circular cross-sectional configuration and a flattened grip area configured for engagement by the user's thumb and an opposed index finger.

In contrast, a search of the U.S. Patent Office database and the databases of several foreign patent offices and other patent organizations, reveals many variations of the traditionally used crochet hook that are configured for differing purposes, but none providing ergonomic structure or benefit similar to that provided by the present invention. For example, U.S. Pat. No. 7,114,354 to Dremann (2006) provides an internally illuminated knitting needle or crochet hook for working with dark yarns, U.S. Pat. No. 4,047,397 to Laliberte (1977) provides a crochet hook with a second hook in a position opposed to the hook used to make new loops (with the second hook providing a protected blade with a sharpened edge to use as a cutting means), and U.S. Pat. No. 6,668,597 to Robinson (2003) provides a crochet hook assembly resembling a circular knitting needle with a hook on each of its ends, an elongate flexible center, and at least one swivel. Furthermore, U.S. Pat. No. 4,846,351 to Gardiner (1989) discloses a knitting and crochet needle kit having multiple shafts and several removable end members each having a pointed or hooked configuration. Two other patent disclosures, U.S. Pat. No. 5,501,688 to Whiteside (1996) and Japanese patent abstract to Organ Needle Co., LTD, having the Publication Number 2008-036316 (published Feb. 21, 2008, for application number 2006-217856 filed Aug. 10, 2006), disclose devices with a hooked end member that are used in medical applications. However, neither of these medical hooks resembles the present invention or appears to have features similar to it. In addition, Japanese patent abstract to Takao Kiyoko, having the Publication Number 2001-248041 (published Sep. 14, 2001, for application number 2000-055525 filed Mar. 3, 2000), discloses a crochet hook attachable over the end of a person's finger, and the following U.S. patents each disclose a crochet hook having a widened shaft that resembles the widened body of an electric toothbrush [U.S. Design Pat. 382,702 to Matuo (1997), U.S. Design Pat. 548,453 to Mihara (2007), U.S. Design Pat. 259,523 to Hopper (1981), and U.S. Pat. No. 4,646,543 to Okada (1987)]. Furthermore, two crochet hook inventions with flattened and curved shafts, each simply entitled "crochet hook", were disclosed in U.S. Design Pat. 401,759 to Marguerie (1998) and U.S. Design Pat. 256,629 to Keller (1980). The non-hooked end of the Keller invention appears to have a flattened but increasingly wide configuration when viewed from the side, perhaps for easier grasping during use and/or better balance in the hand. However, when viewed from the back it appears to have a decreasing taper toward its non-hooked end. In contrast, the Marguerie crochet hook is shown to have a handle with a very small thickness dimension relative to its width, and nine laterally-extending parallel lines visible on its front and back surfaces. A slight curvature visible in the Marguerie handle makes it appear that the parallel lines are used to achieve or facilitate such curvature, either during manufacture or by the end user. Also, the oversized hook attached to the Marguerie crochet hook shaft does not make it appear that the Marguerie crochet hook is contemplated for typical crocheting activity, and may be instead contemplated for hair styling or coloring, and/or other applications. Patents to only one inventor, Hidekazu Okada were found to provide surface modification to crochet hooks. U.S. Design Pat. D273,347 to Okada (1984) and U.S. Design Pat. D270,783 to Okada (1983) each respectively show a crochet hook having a plurality of closely and evenly spaced-apart longitudinally-extending markings in parallel relationship to one another, as well as a plurality of closely and evenly spaced-apart laterally-extending markings in parallel relationship to one another that together form a checkerboard pattern and appearance. The two Okada crochet hooks ('347 and '783) also each have a flattened grip area configured for engagement with the user's thumb and opposed index finger that starts centrally and extends toward the hook. The main visible difference between the two Okada crochet hooks is that the checkerboard markings start at the non-working end of the Okada '783 invention and stop just before reaching the flattened thumb grip area, while the checkerboard markings in the Okada '347 invention start at the non-working end and continue close to and just beyond the flattened thumb grip area. However, the Okada inventions ('347 and '783) do not have the checkerboard markings extending across the flattened thumb grip area, and as a result provide no ergonomic advantage toward relieving the pressure exerted by the flattened thumb grip area against fingers and hand by the crochet hook shaft, which instead of providing ergonomic relief to a user, advantageously fixes the user's hand and fingers in an appropriate orientation relative to the hook for crocheting activity, while at the same time adversely maintaining the crochet hook shaft in a substantially fixed position relative to the hand, providing a result opposite to the present invention, which conversely to the Okada inventions encourages opportunities to provide a variety of movement for a user's fingers and hands relative to its crochet hook shaft and thereby provide ergonomic benefit thereto. Thus, in contrast to the Okada inventions, the present invention comprises elevations changes that start approximately one-and-one-eighth inches from the hook of a crochet hook shaft and extend toward the non-hooked end a longitudinal distance of at least three inches. The exterior surface of a present invention crochet hook shaft also provides elevation changes that extend in a lateral direction fully around it, and no flattened thumb grip area is employed. Furthermore, since crocheting activity involves repeated back-and-forth rotation of the hook, a first rotation of the hook that allows easier insertion into a prior loop and then a second reverse rotation of similar amplitude for snag-free withdrawal of a strand through the prior loop to form a new loop, the flattened thumb grip area on the Okada inventions would cause fixed positioning of a user's fingers against it during new loop creation, and result in premature hand and finger fatigue, whereas the substitution of elevation changes for the flattened thumb grip area, as in the present invention, gives its users the opportunity to occasionally rotate the crochet hook shaft relative to their fingers during new loop creation, thereby bringing differing elevational structure/topography in contact with the skin on the user's fingers and hands, and pressure relief to areas previously experiencing decreased blood circulation, allowing the user to crochet longer, in greater comfort, and with less risk of sustained injury to the fingers and hands. Furthermore, substitution of elevation changes for the flattened thumb grip area in the present invention crochet hooks allows for occasional longitudinal, lateral, and/or diagonal movement of the user's fingers and hand relative to the exterior surface of the crochet hook shaft, providing more opportunity for conscious or unconscious repositioning of the fingers and hands relative to the crochet hook shaft so that the areas of greatest pressure against the user's fingers and hands is allowed to vary. Thus, the checkerboard pattern provided in the Okada inventions in the positions shown cannot provide the same ergonomic benefit experienced during present invention use, since in combination with the flattened thumb grip area it inherently works to restrict the user's finger and hand positioning relative to the crochet hook shaft, which promotes (and does not lessen) the risk of injury to a user's hands and fingers. Furthermore, the close spacing and uniformity of the checkerboard line spacing shown in the two Okada inventions would not be likely to provide much ergonomic relief to a person crocheting, as when they would re-grasp an Okada crochet hook shaft, the contact points between the person's hand and the shaft would more often than not be very close to that used prior to crochet hook release, providing little or no long term circulatory relief. Thus, the Okada inventions do not appear to provide the same disclosure as the present invention. Furthermore, no apparatus or method for crocheting activity is known that functions in the same manner, has all of the same features and components, or provides all of the ergonomic, decorative, convenience, and other advantages of the present invention.

BRIEF SUMMARY OF THE INVENTION

It is the primary object of this invention to provide a handheld device for crocheting that enhances crocheting comfort beyond that currently experienced with traditionally configured crochet hooks having a circular cross-sectional configuration, a flattened thumb grip area, and a smooth exterior surface. It is also an object of this invention to provide a handheld device for crocheting that is more easily held by the person crocheting, irrespective of whether the device is held in an overhand knife grip or and underhand pencil grip, or whether the person is right-handed or left-handed. Another object of this invention is to provide crochet hooks with ergonomic advantage in diminishing the risk of serious, and/or sustained, injury to a user's fingers and hands when used for long periods at a time and/or on successive days. A further object of this invention is to provide a handheld device for crocheting that makes crocheting easier for those having arthritic hands and/or joint problems in the fingers, hands, and/or wrists. It is also an object of this invention to provide a handheld device for crocheting that decreases finger and hand fatigue to extend the time period of comfortable crocheting. In addition, it is an object of this invention to provide crochet hooks with decorative enhancement for enhanced aesthetic appeal.

The present invention, when properly made and used, provides a crochet hook with one or more elevation changes associated with the exterior surface of its shaft that provide ergonomic benefit beginning from approximately one-and-one-eighth of an inch from the tip of the hook, and extending longitudinally through the entire length of the shaft (or at least a distance of approximately three-and-one-half to four-and-one-half inches), to allow crocheting with enhanced comfort, faster crocheting, and/or crocheting for longer periods of time with less risk of hands becoming tired, numb, or aching from the repetitive motion inherent in crocheting activity. In addition to having elevation changes, the present invention crochet hooks may also have a variety of cross-sectional configurations that provide ergonomic benefit, such as that of a triangle with softened corners/edges, in place of the historical circular cross-sectional shape still most commonly used, although a shaft with a circular cross-sectional configuration can still be considered to be within the scope of the present invention as long as elevation changes are also provided. Since the easy sliding of loops off the hook of a crochet hook is important for enhanced crocheting speed, it is not contemplated for elevation changes to be positioned on or near the hook end of a present invention device, and in the alternative non-raised decorative markings could be used thereon to extend the pattern established by the elevation changes elsewhere on a present invention crochet hook. If a present invention crochet hook were to have more than one hook used for loop creation, the same considerations regarding elevation changes applied to a first hook would also apply to additional hooks, as appropriate. Also, more than one size, shape, or thickness of raised protrusion may be used at once on a present invention crochet hook shaft, to provide decorative accent as well as ergonomic benefit, and the spacing between adjacent elevation changes on the same crochet hook may also vary, and/or be different from that on any other present invention crochet hook shaft. It is contemplated for the present invention crochet hooks to be made with different length and diameter dimensions, including standard crochet hook sizes, so as to not require people crocheting to make any fundamental changes in crocheting habits to achieve the gauge recommendations displayed in printed crocheting pattern books and/or other existing instructional crocheting information. Elevation changes used in the present invention can be resilient, or not. The most preferred minimum thickness dimension is approximately 2 millimeters, although any thickness dimension greater than 0.0004 inches would provide at least some ergonomic relief, particularly when combined with a shaft having a non-circular cross-sectional configuration. The maximum protrusion thickness would be guided by the dimension at which the increase in material cost exceeds the benefit provided.

The description herein provides preferred embodiments of the present invention crochet hook, but should not be construed as limiting its scope. For example, variations in the diameter and length dimensions of the present invention crochet hook shafts; whether the elevation changes on each shaft are all the same size and thickness dimension; whether all of the elevation changes on each shaft have uniform spacing from one another or random spacing; whether one elongated raised protrusion (spiral, double spiral, or other) or multiple elevation changes are used; whether the elevation changes on each shaft have different shapes and/or color enhancement; and amount of void space (with no elevation changes) adjacent to the crochet hook tip that is available for ease in pulling newly created loops through existing stitches, other than those shown and described herein, may be incorporated into the present invention. Thus, the scope of the present invention should be determined by the appended claims and their legal equivalents, rather than being limited to the examples given.

COMPONENT LIST

Figure 1:
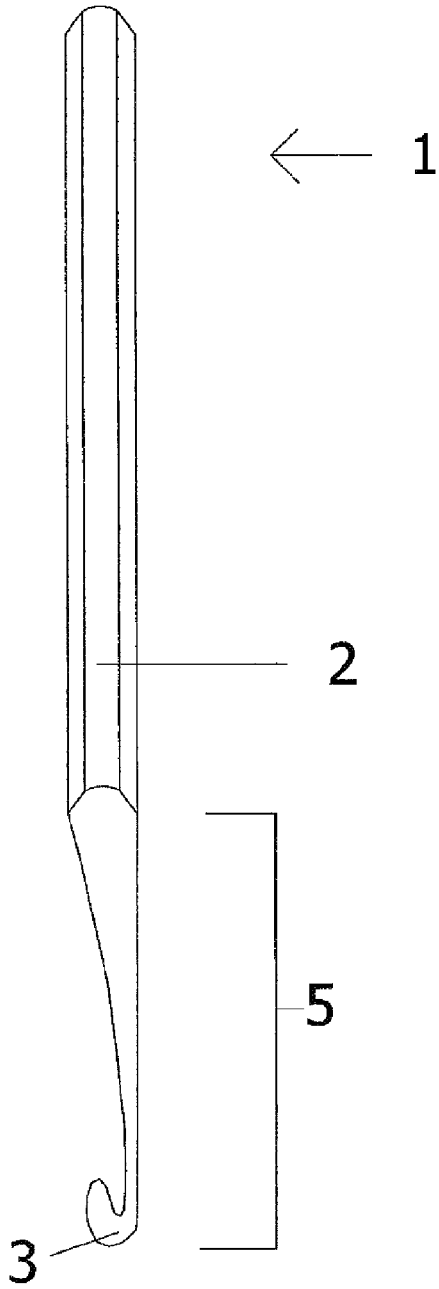
FIG. 1 is a side view of a first preferred embodiment of the present invention having a triangular cross-sectional configuration with softened corners/edges and a tapering work area adjacent to the hook that does not exhibit a triangular cross-sectional configuration.

1—Ergonomic crochet hook invention
2—Crochet hook shaft with a triangular cross-section configuration 4
3—Hook or hooking member associated with shaft 2
4—Triangular cross-section of crochet hook shaft 2
5—New loop creation area of adjacent to hook 3 (which comprises hook 3 and tapering work area 9)
6—Grip-enhancing elevation changes that are in a linear or spiral configuration on shaft 11 of a present invention crochet hook and structured to provide ergonomic advantage
7—Smaller grip-enhancing elevation changes in rows on shaft 11 of a present invention crochet hook and structured to provide ergonomic advantage
8—Larger grip-enhancing elevation changes in a staggered configuration on shaft 11 of a present invention crochet hook and structured to provide ergonomic advantage
9—Void tapering work area adjacent to hook 3 (without elevation changes 6, 7, 8, or other)
10—Non-raised decorative markings on tapering work area 9 and hook 3
11—Crochet hook shaft with a circular cross-sectional configuration

DETAILED DESCRIPTION OF THE INVENTION

Crochet hooks traditionally have had an elongated shaft (11) with a circular cross-sectional configuration and a hook 3 associated with at least one of its ends. They also typically come in standard sizes, so that when printed crocheting instructions are followed, users can have some predictability as to the anticipated size of a finished product, particularly clothing. In addition, a centralized and flattened thumb grip area is a common feature on many crochet hooks currently sold (as well as on many crochet hooks passed down from one generation to the next), and although it does place the hand of a person crocheting in an optimal orientation relative to the hook for its prompt and easy rotation during new loop creation, as well as place the hand holding the shaft at a convenient distance from the hook for efficient and expeditious loop and pattern completion, the flattened thumb grip area also has a significant disadvantage in that it limits hand and finger positioning primarily to the flattened thumb grip area and maintains the crochet hook shaft in a substantially fixed orientation of the shaft relative to the hand. It is this limited opportunity for hand positioning and the fixed orientation relative to the fingers and hand (in combination with the repetitive motion inherent in crocheting activity) that at least in part contributes to the hand stiffness and injury of people crocheting, beginners as well as those with more experience and those who like to crochet often. Various materials have also been used to make prior art crochet hooks, including but not limited to plastic, a variety of metals, bamboo, ivory, and wood, and such materials usually have been lightweight (which is preferred, but not critical). The crocheting process is accomplished by drawing new loops one-at-a-time through a loop previously placed on a crochet hook, with the number of loops pulled therethrough and other steps providing pattern variations.

Figure 2:
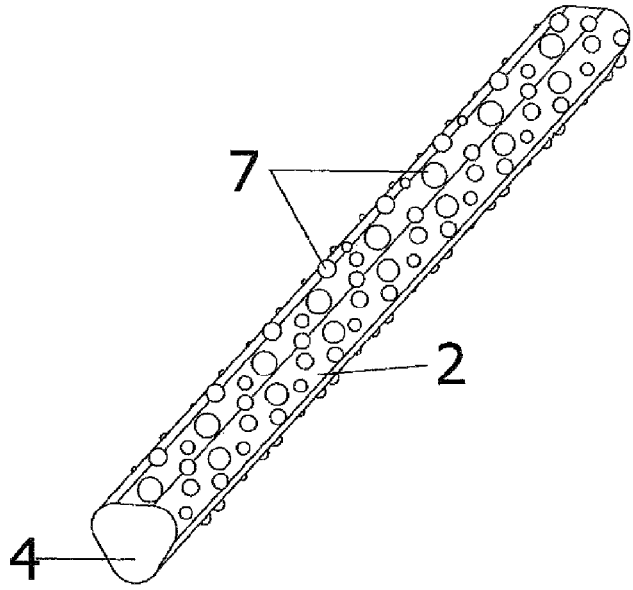
FIG. 2 is a perspective view of the preferred configuration of crochet hook shaft used in the first preferred embodiment of the present invention with the hook and tapering work area omitted for a better view of the shaft's triangular cross-sectional configuration, and further with grip-enhancing elevation changes of varied size associated with its exterior surface that collectively provide additional ergonomic advantage to the hands and fingers of a person using it for crocheting activity.

The elevation changes (6, 7, 8, and other) associated with the present invention crochet hook shafts (2, 11, or other) are configured to alleviate problems of hand fatigue, and lower the risk of repetitive motion injury typically experienced by those crocheting, by creating varied topography on the shaft's exterior surface (both raised protrusions extending above the exterior surface and depressions extending below the exterior surface) that provides a multitude of spaces/areas where no direct contact at all exists between crochet hook shaft (2, 11, or other) and the portions of a user's fingers and hands (not shown) holding it during new loop creation. However, while the overall contact area with the user's hands and fingers is reduced beyond that experienced with traditional crochet hooks, the present invention elevation changes (6, 7, 8, and/or other) are also configured and dimensioned to provide adequate gripping of shaft (2, 11, or other) during crocheting activity so that its user can achieve proper strand tension and needed consistency in loop dimension as new loops are continually created. When the non-contact spaces/areas created by elevation changes 7 are first aligned with a portion of the user's fingers and hands as the person begins crocheting activity, blood circulation in those portions of the user's fingers and hands is not diminished, allowing them initial relief from pressure causing fatigue. Then, during continued crocheting activity, as a user consciously or subconsciously (out of habit) changes the longitudinal, lateral, and/or diagonal positioning of the fingers and hand holding shaft (2, 11 or other), even by a small amount, the portions of the user's fingers and hands previously in close contact with the elevation changes (6, 7, 8, or other) extending the farthest beyond the exterior surface of shaft (2, 11, or other), and thereby experiencing the most pressure exerted against them (as well as having the most diminished blood circulation), now are able to become re-aligned with differing topography, including non-contact spaces/areas, that offer at least temporary relief to those portions of the user's hand and fingers by letting them at least for a short time experience enhanced blood circulation and some fatigue recovery. Thus, through use of the present invention, and due in part to its substitution of elevation changes 7 for the finger-restricting flattened thumb-grip feature found in many prior art crochet hooks and providing elevation changes 7 that extend a full 360-degrees around its shaft (2, 11, or other), the hand and finger positioning of a person crocheting have the opportunity to be varied and frequently re-aligned with differing topography, and as a result they are less likely to become tired and/or numb should long periods of crocheting activity be attempted. Furthermore, when elevation changes (6, 7, 8, or other) are added to a crochet hook shaft having a non-circular cross-sectional configuration (such as but not limited to the generally triangular configuration 4 with softened edges/corners that is shown in FIGS. 1 and 2), the ergonomic benefit derived by a user's fingers and hand is further enhanced beyond the mere addition of elevation changes (6, 7, 8, or other) as a result of the perimeter features of the non-circular cross-sectional configuration that provide additional topography changes that contribute additional/new occurrences of varied hand and finger positioning, and the increased variance in relief from pressure exerted by the shaft (2, 11 or other) against the hands and fingers of a user gives more opportunity for enhanced blood circulation and fatigue recovery throughout a greater portion of the fingers and hand holding the shaft (2, 11, or other). No crochet hooks have been found, or are known, with elevation changes in combination with shafts having a non-circular cross-sectional configuration similar to that proposed by the present invention, or that promote easy gripping with less fatigue for the fingers and hands of those crocheting. No other apparatus or method is known that functions in the same manner or provides all of the advantages of the present invention.

FIG. 1 is a side view of a first preferred embodiment of the present invention 1 crochet hook configured and dimensioned to provide ergonomic benefit, and having a shaft 2 with triangular cross-sectional configuration 4 (shown more clearly in FIG. 2), a hook 3 connected to one end of shaft 2, and a tapering work area (designated by the number 9 in FIGS. 3 and 4) that is adjacent to the hook 3. Although not shown, shaft 2 could have two different sizes of hook 3 in opposed positions on each of its opposite ends (each with an adjacent tapering work area 9), and thus the number of hooks 3 employed in the present invention is not considered critical. As seen in FIG. 1, the tapering work area 9 and hook 3 together form a new loop creation area 5. In FIG. 1, the triangular cross-sectional configuration 4 does not extend into the new loop creation area 5, although it could (at least in part) as long as softened edges remain present. Manufacturing considerations would be one of the limiting factors guiding the extent to which a non-circular cross-sectional configuration could extend into tapering work area 9. Another such factor would be the need for prompt movement of loops over hook 3 and onto shaft 2 for achieving consistency in loop dimension (which is typically needed in crocheting, particularly when making clothing). At a minimum, tapering work area 9 should have a surface configuration and texture (or lack thereof) that permits easy movement of loops across it. Although not limited thereto and noting that other cross-sectional configurations for tapering work area 9 are considered to be within the scope of the present invention, in most applications tapering work area 9 would be expected to have the cross-sectional configuration of a circle, ellipse, or oval. FIG. 2 is a perspective view of the shaft 2 of a present invention crochet hook 1 having a triangular cross-sectional configuration 4 and a plurality of elevation changes 7 of varied size associated with its exterior surface that collectively provide additional ergonomic advantage for a user. Elevation changes 7 can include protrusions raised above the exterior surface of shaft 2, as well as depressions extending below the exterior surface of shaft 2, or a combination thereof. In the present invention, elevation changes 7 should be taken into account when making standard sizes of shaft 2 so that gauge recommendations in printed crocheting instructions can be easily achieved by a user. Also, it is contemplated for elevation changes 7 to be a minimum of approximately 0.0004 inches in thickness or depth, and have a maximum thickness or depth dimension at the point where ergonomic benefit, comfort, and/or easy movement of loops onto shaft 2 are no longer provided, generally determined by the inventor herein to be approximately 4 or 5 millimeters (but it would not be limited to these dimensions in all contemplated applications). Also, elevation changes 7 are not always limited to the circular configuration shown in FIG. 2, and elevation changes (6, 7, 8 and other), may have any configuration that promotes ergonomic benefit, including but not limited to that of regular polygons, abstract configurations, butterflies, flowers, hearts, lady bugs, artistic renditions of one or more recognizable people or objects, or an elongated line or combination of lines in a spiral or other configuration. However, the portions of elevation changes (7 or other) immediately adjacent to tapering work area 9 should have no sharp edges that could snag loops as they are moved over hook 3 and onto shaft 2, or detract from the comfort of finger and hand tissue held closely against them. Also, elevation changes 7 in the form of raised protrusions may have a convex configuration to minimize interference with needed loop movement onto shaft 2, and/or make them more comfortable for extended contact with fingers and hands. In addition, whether shaft 2 has a triangular or other cross-sectional configuration, it is also contemplated for elevation changes 7 to extend a full 360-degrees around the exterior surface of shaft 2 to accommodate fingertips or portions of a hand that may be in contact with the underside portions of shaft 2. Although elevation changes 7 help to provide ergonomic benefit when associated with shafts (2, 11, or other) of any diameter dimension, they are particularly useful in crocheting activity performed with large diameter shafts 2 (due to the greater amount of exterior surface area in contact with the hands and fingers of a user), but will also be helpful to those using very small diameter shafts 2 (such as a size "00" crochet hook which typically has a diameter dimension of approximately three-thirty-seconds of an inch), which are difficult and tedious to hold, and require a greater amount of pressure applied by the fingers and hands of a user to achieve consistency in loop dimension. By way of further example as to the composition of elevation changes 7, they may also include, but are not limited to, channels having a depth dimension and extending below said exterior surface of said elongated shaft, grooves having a depth dimension and extending below said exterior surface of said elongated shaft, one raised protrusion in a spiral pattern, more than one raised protrusion in a spiral pattern, elevation changes having a small diameter dimension, elevation changes having a small length dimension, elevation changes having a small width dimension, elevation changes spaced apart from one another in rows, elevation changes oriented in a staggered pattern, elevation changes having a single width dimension, multiple elevation changes at least two of which have different width dimensions, elevation changes having a single length dimension, multiple elevation changes at least two of which have different length dimensions, elevation changes having a single diameter dimension, multiple elevation changes at least two of which have different diameter dimensions, elevation changes having similar spaced apart distances from one another, multiple elevation changes having at least two different spaced-apart distances from one another, elevation changes all having the same thickness dimension, multiple elevation changes at least two of which have different thickness dimensions, elevation changes all having the same depth dimension, multiple elevation changes at least two of which have different depth dimensions, and elevation changes having a minimum thickness dimension of approximately 0.0004 inches.

In FIG. 2, the hook 3 and tapering work area 9 are omitted to provide a better view of triangular cross-sectional configuration 4 with softened edges that is used in some preferred embodiments of the present invention. Although the cross-sectional configuration of the shaft 2 shown in FIGS. 1 and 2 is that of a triangle, it is contemplated for the present invention crochet hook 1 to have any non-circular cross-sectional configuration that provides additional ergonomic relief to the hands and fingers of its user, such as but not limited to that of a triangle, pentagon, hexagon, or octagon, as long as the shape used in combination with elevation changes 7 provides the needed ergonomic benefits of enhanced crocheting enjoyment with less stiffness and/or soreness in the hands and fingers, and less risk of repetitive motion injury. Manufacturing of non-circular present invention crochet hook shafts, such as but not limited to the triangular shaft 2 in FIG. 1, can begin with a circular shape that is crimped to provide the triangular configuration 4 with softened corners, or provide another non-circular configuration desired.

Figure 3:
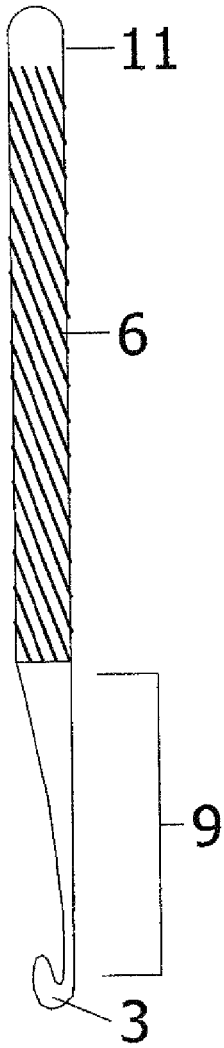
FIG. 3 is a side view of a second preferred embodiment of the present invention having a circular cross-sectional configuration and elevation changes in a linear or spiral configuration that are structured to provide ergonomic advantage, and a tapering work area adjacent to the hook not exhibiting elevation changes.
Figure 4:
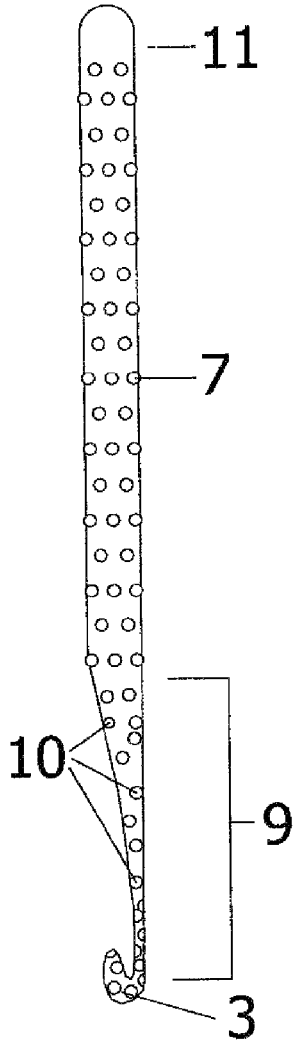
FIG. 4 is a side view of a third preferred embodiment of the present invention having a circular cross-sectional configuration, small grip-enhancing elevation changes in rows that are structured to provide ergonomic advantage, and a tapering work area adjacent to the hook having non-raised decorative extensions.
Figure 5:
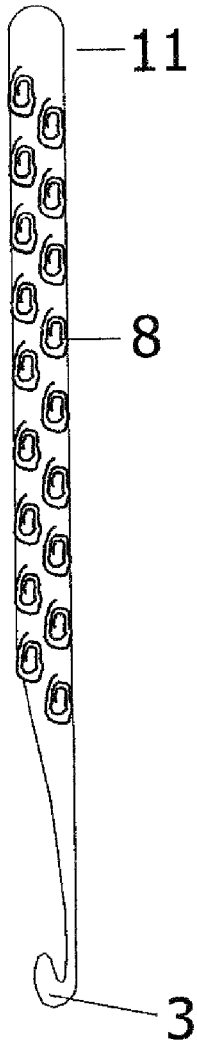
FIG. 5 is a side view of a fourth preferred embodiment of the present invention having a circular cross-sectional configuration, large grip-enhancing elevation changes in a staggered configuration structured to provide ergonomic advantage, and a tapering work area adjacent to the hook not exhibiting elevation changes.

In contrast, FIGS. 3, 4, and 5 show three different embodiments of the present invention each having a shaft 11 with a circular cross-sectional configuration, with differences between them being the type of elevation changes (6, 7, or 8) used. FIG. 3 is a side view of a second preferred embodiment of the present invention having a circular cross-sectional configuration and ergonomic benefit providing (also grip-enhancing) elevation changes 6 in a linear or spiral configuration (including at-least-one raised protrusion or depression)

that provides ergonomic advantage to a person gripping it with fingers and portions of a hand. FIG. 3 also shows hook 3 and the tapering work area 9 adjacent to hook 3 lacking elevation changes 6. FIG. 4 is a side view of a third preferred embodiment of the present invention having a circular cross-sectional configuration, small elevation changes 7 in spaced-apart rows and otherwise separated to provide ergonomic advantage, and non-raised decorative extensions 10 associated with the hook 3, as well as the tapering work area 9 adjacent to hook 3. FIG. 5 is a side view of a fourth preferred embodiment of the present invention having a circular cross-sectional configuration, and large elevation changes 8 in a staggered configuration that provides ergonomic advantage. FIG. 5 also show hook 3 and the tapering work area 9 adjacent to hook 3 lacking elevation changes (8 or other). None of the embodiments of the present invention shown in FIG. 3, 4, or 5 comprise a centralized and flattened thumb grip area that is a common feature on many traditional crochet hooks, and which places the hand of a person crocheting in an optimal orientation relative to the hook for its prompt and easy rotation during new loop creation, as well as places the hand holding it at a convenient distance from the hook for efficient and expeditious loop and pattern completion, but which also has the significant disadvantage of substantially restricting hand and finger positioning and orientation so that little movement onto other portions of the shaft can be easily accomplished. It is this limited opportunity for hand positioning and the fixed orientation of the shaft relative to the fingers and hand (in combination with the repetitive motion inherent in crocheting activity) that at least in part contributes to the hand stiffness and risk of repetitive motion injury for people crocheting with prior art crochet hooks, beginners as well as those with more experience and those who like to crochet often.

The non-raised decorative extensions 10 shown in FIG. 4 provide a pattern extension similar in configuration to the elevation changes 7 on shaft 11, but such similarity is not critical and the non-raised decorative extensions 10 employed could also provide a visual contrast to elevation changes 7 via differences in color, size, texture, pattern arrangement, and the like. Furthermore, non-raised decorative extensions 10 can be printed or stamped on tapering work area 9 and hook 3, as long as they remain substantially flush with the exterior surface of shaft (11, 2, or other) and otherwise durable for long-term use with hook 3 and tapering work area 9, and provide no interference with fast and efficient loop movement onto shaft (11, 2, or other) that is needed to achieve consistency in loop dimension, which is particularly important when production of true-to-size clothing is desired while following written crocheting instructions. Although the presence of non-raised decorative extensions 10 on hook 3 may be desirable for aesthetic reasons, their use on hook 3 is not critical. Furthermore, in addition to the printing and stamping noted above, other means for associating non-raised decorative extensions 10 with tapering work area 9 and hook 3 are also considered to be within the scope of the present invention, as long as durability and non-interference goals are still met. Also, the non-raised decorative extensions 10 in FIG. 4 merely show one example of the possible visual appearance of decorative extensions 10 as they would be used in the present invention. Whether they are used as a pattern extension or not, their appearance and/or spacing may be similar or contrasting to the elevation changes (6, 7, 8, or other) also present on the same present invention shaft (2, 11, or other), and the specific size, configuration, spaced-apart positioning, proportion of large or small sizes, and/or any other visual determinations derived from the non-raised decorative extensions 10 shown in FIG. 4 should not be considered as a limitation for the present invention. Furthermore, while FIG. 4 shows elevation changes 7 and decorative extensions 10 each having a circular configuration, it is not contemplated for either to be limited only to the circular configurations shown. Additionally, the elevation changes used (6, 7, 8, or other) should also not be so pronounced that they interfere with the easy movement of newly created loops (not shown) onto shaft (2, 11, or other) needed to establish uniform size and/or proper gauge thereof. In contrast to the positioning of non-raised decorative extensions 10 in the area adjacent to hook 3, it is contemplated for the elevation changes (6, 7, 8, or other) to generally extend from a position at or close to the end of shaft (2, 11, or other) that is remote from hook 3 (unless two hooks are present) to a position having a distance of approximately one to one-and-one-eighth inches from the hook 3. Furthermore, as illustrated in FIG. 2, more than one size or shape of elevation changes (6, 7, 8, or other) may be used at once on the shaft (2, 11, or other) of a present invention crochet hook, and the same applies to non-raised decorative extensions 10. Also, the spacing/areas between adjacent elevation changes (6, 7, 8, or other), as well as between any non-raised decorative extensions 10 on the same present invention shaft (2, 11, or other), may be varied. For crochet hooks with two opposed hooks 3, elevation changes 7 and any ergonomic cross-sectional configuration would be present centrally on shaft (2, 11, or other), and preferably extend to a position approximately one-and-one-eighth inches (or in the alternative as little as approximately one inch to a location as much as approximately two inches) from the tip of each hook 3.

In addition to being configured for ergonomic comfort, it is contemplated that present invention crochet hooks would be made in different sizes, including standard crochet hook dimensions, so as to not require people crocheting to make any fundamental changes in crocheting habits to achieve the gauge recommendations typically displayed in previously printed crocheting pattern books and other existing instructional information. Thus, the length and thickness dimensions of a present invention crochet hook would not be limited to a single size, but could be made in any length or thickness dimension that is convenient for a user (the standard sizes used for prior art crochet hooks and/or other). Although not shown, variations of the second, third, and fourth preferred embodiments of a present invention crochet hook could also include, but are not limited to, providing a hook 3 with differences in proportion or configuration from that shown in FIGS. 1, 3, 4, and 5 (as long as it can still promptly and easily fulfill its new loop creation function), providing a portion of shaft 2 remote from hook 3 with an enlarged diameter/thickness dimension as compared to the remainder of shaft 2 (particularly helpful to users working with very small diameter shafts 2, such as but not limited to a size "0" or "00" shaft 11 having a thickness dimension that would otherwise be only three-thirty-seconds of an inch), and providing a tapering work area 9 with a tapering configuration more or less elongated than that shown in FIGS. 1, 3, 4, and 5. In addition, elevation changes (6, 7, 8, or other) and/or shaft (2, 11, or other) in the present invention may be made from resilient material that has grip-enhancing properties. Also, the material from which the present invention shaft (2 11, or other) is made would preferably be a lightweight metal, plastic, wood, or bamboo, although other lightweight materials or combinations that would allow for easy movement of loops onto shaft (2, 11, or other) are also considered to be within the scope of the present invention.

What is claimed is:

1. A crochet hook providing ergonomic benefit to the person using it to from one or more loops in an elongated strand and then connect them in a structured mariner to other previously formed loops to create two-dimensional and three-dimensional objects, the making of stitches or patterns accomplished by pulling new loops one-at-a-time in varying combinations, as needed, through one or more previously created loops, and then if such activity causes more than one loop to become associated with the crochet hook, removing excess loops from the crochet hook, one or more at a time, until only a single loop remains that can be tied off or used as a basis to continue the next stitch or pattern, said crochet hook comprising:

an elongated shall having opposing ends and an exterior surface;

a hook associated with at least one of said opposing ends of said elongated shaft;

a tapering work area on said elongated shaft adjacent to each said hook; and multiple spaced-apart and mixed-level elevation changes associated with said exterior surface of said elongated shaft, said elevation changes extending laterally around said elongated shaft and incorporating materials selected from a group consisting of resilient materials and non-resilient materials, said elevation changes also being selected from a group consisting of elevation changes having a thickness dimension and extending outwardly beyond said exterior surface of said elongated shaft and elevation changes having a depth dimension and extending below said exterior surface of said elongated shaft, said elevation changes also only partially covering said exterior surface while creating a varied topography that gives those crocheting many opportunities to vary contact point alignment between said elongated shaft and the fingers and hand holding it, that provides pressure relief to portions of the fingers and hand during new loop creation and sizing, with the opportunity for frequent readjustment of finger and hand positioning around said shaft such that the fingers and hand holding said elongated shaft repeatedly encounter a differing selections of said elevation changes and pressure relief topography each of the many times said shaft is re-grasped by the fingers and hands during crocheting activity, thus allowing the opportunity for crocheting activity to occur with enhanced comfort of said fingers and hands, greater speed, and for longer periods of time while reduced incidence of repetitive motion injury, less pain, reduced joint damage, less incidence of hands becoming prematurely tired before the person crocheting wants to stop, less incidence of hands and fingers becoming numb, and less incidence of hands and fingers aching from the repetitive motion inherent in crocheting activity are also experienced.

2. The crochet hook of claim 1 wherein said elevation changes extend along said shaft away from said hook starting at least from a location of approximately one inch to one-and-one-eighth inches from each said hook.

3. The crochet hook of claim 2 wherein said elevation changes are selected from a group consisting of raised protrusions having a thickness dimension and extending outwardly beyond said exterior surface of said elongated shaft, depressions having a depth dimension and extending below said exterior surface of said elongated shaft, channels having a depth dimension and extending below said exterior surface of said elongated shaft, grooves having a depth dimension and extending below said exterior surface of said elongated shaft, one raised protrusion in a spiral pattern, more than one raised protrusion in a spiral pattern, elevation changes having a small diameter dimension, elevation changes having a small length dimension, elevation changes having a small width dimension, elevation changes spaced apart from one another in rows, elevation changes oriented in a staggered pattern, elevation changes having a single width dimension, multiple elevation changes at least two of which have different width dimensions, elevation changes having a single length dimension, multiple elevation changes at least two of which have different length dimensions, elevation changes having a single diameter dimension, multiple elevation changes at least two of which have different diameter dimensions, elevation changes having similar spaced apart distances from one another, multiple elevation changes having at least two different spaced-apart distances from one another, elevation changes all having the same thickness dimension, multiple elevation changes at least two of which have different thickness dimensions, elevation changes all having the same depth dimension, multiple elevation changes at least two of which have different depth dimensions, and elevation changes having a minimum thickness dimension of approximately 0.0004 inches.

4. The crochet hook of claim 1 wherein said shaft further comprises a non-circular cross-sectional configuration.

5. The crochet hook of claim 4 wherein said elevation changes have a minimum thickness dimension of approximately 0.0004 inches.

6. The crochet hook of claim 1 wherein said hook is configured without said elevation changes.

7. The crochet hook of claim 1 wherein said shaft is made from materials selected from a group consisting of resilient materials and non-resilient materials.

8. The crochet hook of claim 1 further comprising decorative markings selected from a group consisting of decorative markings associated with said tapering work area, decorative markings associated with said hook, and decorative markings substantially flush with said exterior surface of said shaft.

9. The crochet hook of claim 8 wherein said decorative markings are further selected from a group consisting of decorative markings having the same shape as said elevation changes associated with said shaft, decorative markings having a different shape from said elevation changes associated with said shaft, and decorative markings having an appearance similar to that of said elevation changes on said shaft to provide a non-distinct visual extension of said elevation changes.

10. A crochet hook providing ergonomic benefit to the person using it to form one or more loops in an elongated strand and then connect them in a structured manner to other previously formed loops to create two-dimensional and three-dimensional objects, the making of stitches or patterns accomplished by pulling new loops one-at-a-time in varying combinations, as needed, through one or more previously created loops, and then if such activity causes more than one loop to become associated with the crochet hook, removing excess loops from the crochet hook, one or more at a time, until only a single loop remains that can be tied off or used as a basis to continue the next stitch or pattern, said crochet hook comprising:

an elongated shaft having opposing ends and an exterior surface;

a hook associated with at least one of said opposing ends of said elongated shaft;

a tapering work area on said elongated shaft adjacent to each said hook present;

at least one decorative marking selected from a group consisting of decorative markings associated with said tapering work area, decorative markings associated with said hook, and decorative markings substantially flush with said exterior surface of said shaft; and multiple spaced-apart and mixed-level elevation changes associated with said exterior surface of said elongated shaft, said elevation changes extending laterally around said elongated shaft and incorporating materials selected from a group consisting of resilient materials and non-resilient materials, said elevation changes also being selected from a group consisting of elevation changes having a thickness dimension and extending outwardly beyond said exterior surface of said elongated shaft and elevation changes having a depth dimension and extending below said exterior surface of said elongated shaft, said elevation changes extending along said shaft away from said hook starting at least from a location of approximately one inch to one-and-one-eighth inches from each said hook, said elevation changes also only partially covering said exterior surface while creating a varied topography that gives those crocheting many opportunities to vary contact point alignment between said elongated shaft and the fingers and hand holding it, that provides pressure relief to portions of the fingers and hand during new loop creation and sizing, with the opportunity for frequent readjustment of finger and hand positioning around said shaft such that the fingers and hand holding said elongated shaft repeatedly encounter a differing selections of said elevation changes and pressure relief topography each of the many times said shaft is re-grasped by the fingers and hands during crocheting activity, thus allowing the opportunity for crocheting activity to occur with enhanced comfort of said fingers and hands, greater speed, and for longer periods of time while reduced incidence of repetitive motion injury, less pain, reduced joint damage, less incidence of hands becoming prematurely tired before the person crocheting wants to stop, less incidence of hands and fingers becoming numb, and less incidence of hands and fingers aching from the repetitive motion inherent in crocheting activity are also experienced.

11. The crochet hook of claim 10 wherein said elevation changes are selected from a group consisting of raised protrusions having a thickness dimension and extending outwardly beyond said exterior surface of said elongated shaft, depressions having a depth dimension and extending below said exterior surface of said elongated shaft, channels having a depth dimension and extending below said exterior surface of said elongated shaft, grooves having a depth dimension and extending below said exterior surface of said elongated shaft, one raised protrusion in a spiral pattern, more than one raised protrusion in a spiral pattern, elevation changes having a small diameter dimension, elevation changes having a small length dimension, elevation changes having a small width dimension, elevation changes spaced apart from one another in rows, elevation changes oriented in a staggered pattern, elevation changes having a single width dimension, multiple elevation changes at least two of which have different width dimensions, elevation changes having a single length dimension, multiple elevation changes at least two of which have different length dimensions, elevation changes having a single diameter dimension, multiple elevation changes at least two of which have different diameter dimensions, elevation changes having similar spaced apart distances from one another, multiple elevation changes having at least two different spaced-apart distances from one another, elevation changes all having the same thickness dimension, multiple elevation changes at least two of which have different thickness dimensions, elevation changes all having the same depth dimension, multiple elevation changes at least two of which have different depth dimensions, and elevation changes having a minimum thickness dimension of approximately 0.0004 inches.

12. The crochet hook of claim 10 wherein said shaft further comprises a non-circular cross-sectional configuration.

13. The crochet hook of claim 10 wherein said decorative markings are further selected from a group consisting of decorative markings having the same shape as said elevation changes associated with said shaft, decorative markings having a different shape from said elevation changes associated with said shaft, and decorative markings having an appearance similar to that of said elevation changes on said shaft to provide a non-distinct visual extension of said elevation changes.

14. A method for making the ergonomically beneficial crochet hook of claim 4, said method comprising the steps of:

providing said elongated shaft with its non-circular cross-sectional configuration and exterior surface; and associating said multiple spaced-apart and mixed-level elevation changes with said exterior surface of said elongated shaft without associating said elevation changes with said tapering work area so that said elevation changes extend along said shaft away from said hook starting at least from a location of approximately one inch to one-and-one-eighth inches from each said hook, said elevation changes also only partially covering said exterior surface while creating a varied topography that gives those crocheting many opportunities to vary contact point alignment between the elongated shaft and the fingers and hand holding it, which provides pressure relief to portions of the fingers and hand holding it for new loop creation and sizing, with the opportunity for frequent readjustment of finger and hand positioning around said shaft such that the fingers and hand holding said elongated shaft repeatedly encounter differing selections of said elevation changes and pressure relief topography each of the many times said shaft is re-grasped by the fingers and hand during crocheting activity, thus allowing the opportunity for crocheting activity to occur with enhanced comfort of said fingers and hand holding it, greater speed, and for longer periods of time while reduced incidence of repetitive motion injury, less pain, reduced joint damage, less incidence of hands becoming prematurely tired before the person crocheting wants to stop, less incidence of hands and fingers becoming numb, and less incidence of hands and fingers aching from the repetitive motion inherent in crocheting activity are also experienced.

15. The method of claim 14 wherein said elevation changes are selected from a group consisting of raised protrusions having a thickness dimension and extending outwardly beyond said exterior surface of said elongated shaft, depressions having a depth dimension and extending below said exterior surface of said elongated shaft, channels having a depth dimension and extending below said exterior surface of said elongated shaft, grooves having a depth dimension and extending below said exterior surface of said elongated shaft, one raised protrusion in a spiral pattern, more than one raised protrusion in a spiral pattern, elevation changes having a small diameter dimension, elevation changes having a small length dimension, elevation changes having a small width dimension, elevation changes spaced apart from one another in rows, elevation changes oriented in a staggered pattern, elevation changes having a single width dimension, multiple elevation changes at least two of which have different width dimensions, elevation changes having a single length dimension, multiple elevation changes at least two of which have different length dimensions, elevation changes having a single diameter dimension, multiple elevation changes at least two of which have different diameter dimensions, elevation changes having similar spaced apart distances from one another, multiple elevation changes having at least two different spaced-apart distances from one another, elevation changes all having the same thickness dimension, multiple elevation changes at least two of which have different thickness dimensions, elevation changes all having the same depth dimension, multiple elevation changes at least two of which have different depth dimensions, and elevation changes having a minimum thickness dimension of approximately 0.0004 inches.

16. The method of claim 14 wherein said shaft further comprises a non-circular cross-sectional configuration.

17. The method of claim 14 further comprising the step of providing of substantially non-raised decorative markings and the step of associating said substantially non-raised decorative markings with said tapering work area.

18. The method of claim 17 wherein said decorative markings are selected from a group consisting of decorative markings having the same shape as said elevation changes associated with said shaft, decorative markings having a different shape from said elevation changes associated with said shaft, and decorative markings having an appearance similar to that of said elevation changes on said shaft to provide a non-distinct visual extension of said elevation changes.

19. The method of claim 17 wherein said steps of providing said non-raised decorative markings and associating said non-raised decorative markings with said tapering work area can occur before or after said step of associating said at least one raised protrusion with said outer surface of said elongated shaft.

20. The method of claim 14 further comprising the step of providing of substantially non-raised decorative markings, the step of associating said substantially non-raised decorative markings with at least one said hook, and wherein said decorative markings are selected from a group consisting of decorative markings having the same shape as said elevation changes associated with said shaft, decorative markings having a different shape from said elevation changes associated with said shaft, and decorative markings having an appearance similar to that of said elevation changes on said shaft to provide a non-distinct visual extension of said elevation changes, and further wherein said steps of providing said non-raised decorative markings and associating said non-raised decorative markings with one said hook can occur before or after said step of associating said at least one raised protrusion with said outer surface of said elongated shaft.

* * * * *